US007416357B2

(12) United States Patent
Thiebaut

(10) Patent No.: US 7,416,357 B2
(45) Date of Patent: Aug. 26, 2008

(54) APPLICATOR DISPENSER

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 11/147,262

(22) Filed: Jun. 8, 2005

(65) Prior Publication Data

US 2005/0276653 A1 Dec. 15, 2005

Related U.S. Application Data

(60) Provisional application No. 60/580,097, filed on Jun. 17, 2004.

(51) Int. Cl.
*B43K 23/02* (2006.01)

(52) U.S. Cl. ..... 401/131; 401/133; 401/183; 401/196; 401/205

(58) Field of Classification Search ..... 401/132–135, 401/196, 205, 131, 183; 221/255, 266, 303, 221/309
See application file for complete search history.

(56) References Cited

U.S. PATENT DOCUMENTS 3,386,793 A 6/1968 Stanton
3,677,438 A * 7/1972 Esposito ..... 221/63
3,729,421 A * 4/1973 Gibson et al. ..... 510/148
4,014,616 A 3/1977 Mast, Jr. et al.
4,053,242 A 10/1977 Mast, Jr.
4,101,053 A 7/1978 Mast, Jr.
4,140,409 A 2/1979 DeVries
4,261,480 A * 4/1981 Fuss ..... 221/304
4,319,696 A * 3/1982 Stevens ..... 221/310
4,430,013 A * 2/1984 Kaufman ..... 401/132
4,858,784 A * 8/1989 Moody ..... 221/307
6,007,264 A 12/1999 Koptis
6,493,898 B1 * 12/2002 Woods et al. ..... 15/209.1
6,902,335 B2 * 6/2005 Bergey et al. ..... 401/132

FOREIGN PATENT DOCUMENTS

FR 1263715 6/1961

* cited by examiner

*Primary Examiner*—Khoa D Huynh
(74) *Attorney, Agent, or Firm*—Oblon, Spivak, McClelland, Maier & Neustadt, P.C.

(57) ABSTRACT

A dispenser that includes at least one receptacle configured to accommodate at least one applicator, with the receptacle having at least one opening through which the applicator can be withdrawn. At least one applicator is housed in the receptacle, and includes an applicator portion and a grasping element enabling the applicator to be held. The grasping element delineates a reservoir containing a product to be applied, and the applicator is configured so that it must be at least partially deformed in order to pass through the opening in the receptacle.

47 Claims, 4 Drawing Sheets

Fig. 1
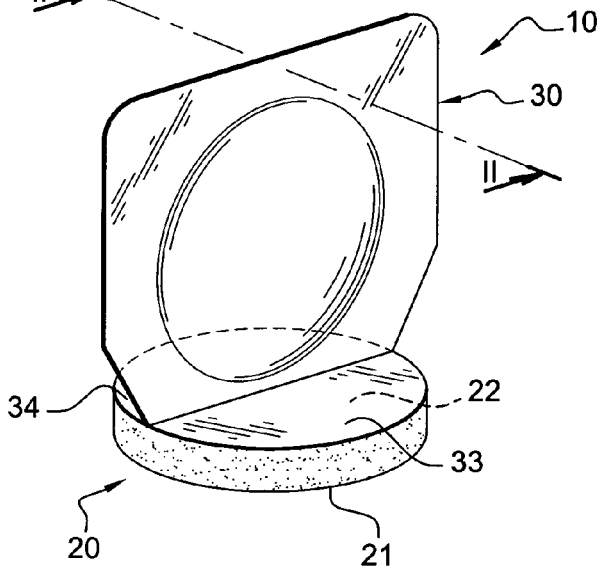
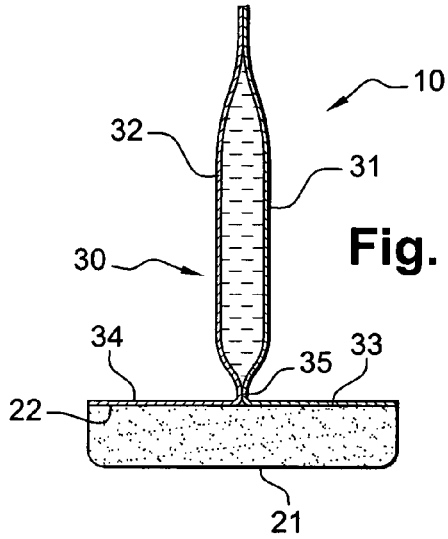
Fig. 2
Fig. 3
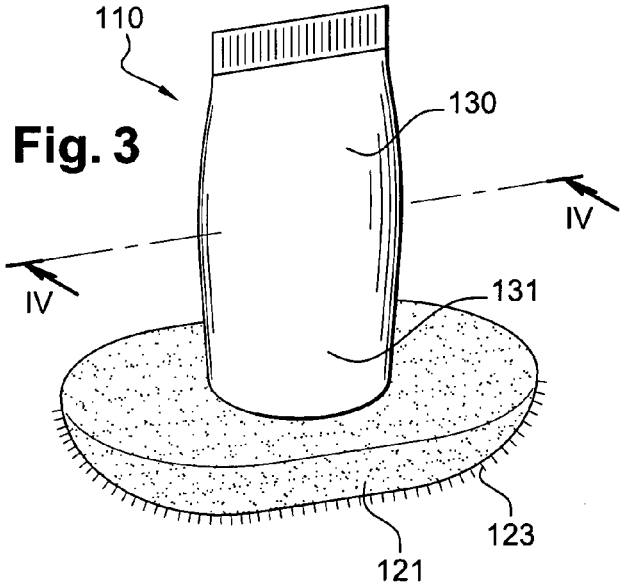
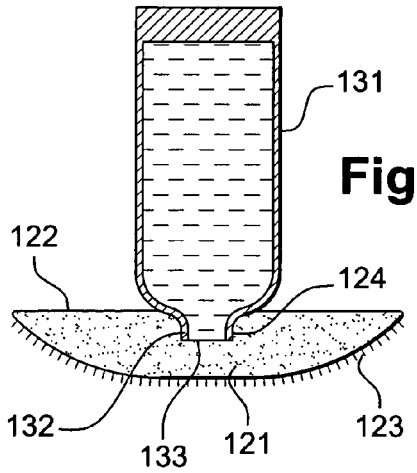
Fig. 4

Fig. 5A
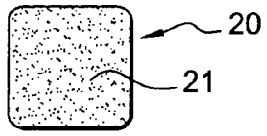
Fig. 5B
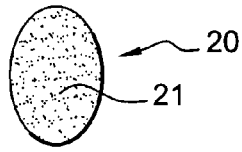
Fig. 5C
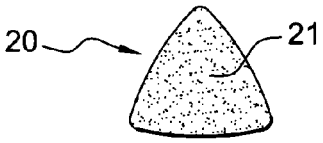
Fig. 5D
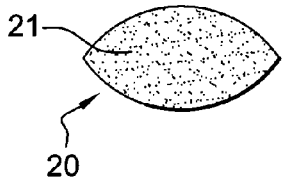
Fig. 5E
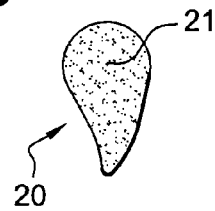
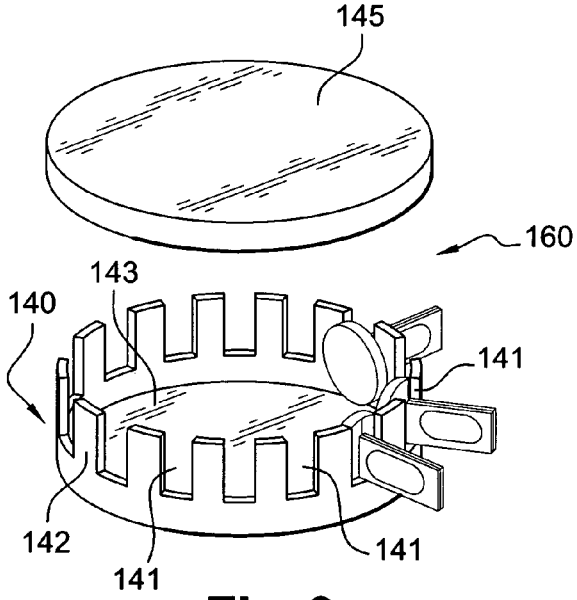
Fig. 9
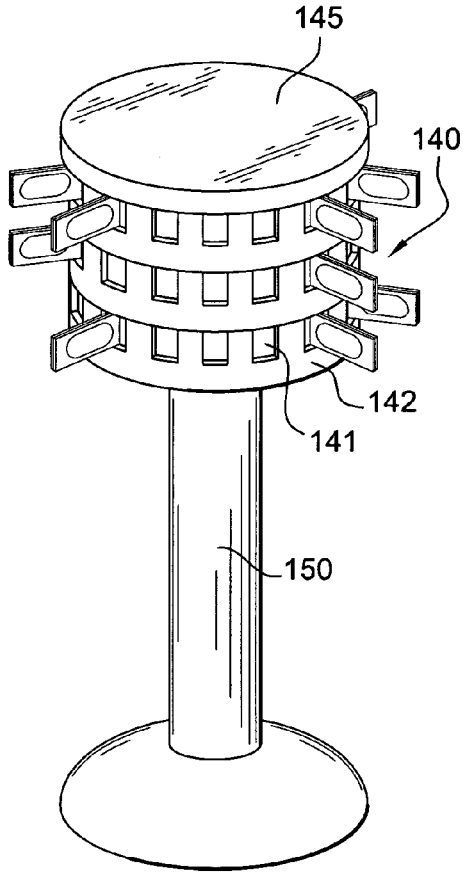
Fig. 10

APPLICATOR DISPENSER

CROSS-REFERENCE TO RELATED APPLICATIONS

This document claims priority to French Application Number 04 51131, filed Jun. 8, 2004 and U.S. Provisional Application No. 60/580,097, filed Jun. 17, 2004, the entire content of which are hereby incorporated by reference.

BACKGROUND OF THE INVENTION

1. Field of the Invention

The present invention relates to a dispenser for at least one applicator. The invention is particularly advantageous for a cosmetic product applicator intended for single use.

2. Discussion of Background

In the field of cosmetics, it is common to give customers an opportunity to test products in order to enable them to choose the product they are going to buy. To this end, it is known to package products in the form of a single dose which the customer can use at home before making his/her purchase.

Alternatively, the products can be made available to the customer at a point of sale with a community container available for use. However, with this approach, the customer is required to take up and apply the product with the fingers in order to test it before making the purchase. Such an approach is not very hygienic given that a large number of customers may use the same product.

For this reason, it is useful to provide single-use product applicators, which can be made available to customers at the point of sale of the products to enable them to sample and apply the product before disposing of the applicator.

Applicators intended for single use are generally of small size such that it is commonplace to provide them with means enabling them to be grasped. Certain applicators of the single use type are for example T-shaped, i.e. they include an applicator portion delineating an application surface and a handle portion formed perpendicular to the application surface. U.S. Pat. Nos. 4,053,242; 4,101,053; and 4,014,616 describe examples of such applicators.

In certain cases, the handle can additionally contain a measured quantity of product to be applied, as is the case with the applicator described in U.S. Pat. No. 6,007,264, which additionally serves to protect the quantity of product to be applied and provides a disposable two-in-one device.

However, applicators intended for single use are rarely protected against the external environment so that their application surface is liable to be soiled. This is more particularly true in the case of T-shaped applicators which can be difficult to accommodate in a conventional holder or case.

In addition, when such applicators are made available to customers at a point of sale, it can be desirable to facilitate the dispensing thereof. U.S. Pat. Nos. 4,014,616; 4,053,242; and 4,101,053 describe examples of dispensers which facilitate both the protection and dispensing of the applicators.

In particular, U.S. Pat. No. 4,014,616 describes a device in the form of a cylindrical housing incorporating an opening at its upper end which can be closed by a cover. The applicators are relatively rigid and are superimposed inside the housing so as to form a stack. The handle of the applicators is hollow so as to receive the handle of the following applicator so as to reduce the dimensions of the stack. The applicators have their handle oriented towards the opening in the housing so that when the cover is removed, the user can take hold of the handle in order to pick up an applicator. A spring is additionally provided in the bottom of the housing to push the stack towards the opening as the applicators are taken out, and the applicator closest to the opening is held in the housing by means of a lip delineating the opening against which the periphery of the applicator is in bearing contact. The drawback of this system is that the spring wears over time so that the last applicators have difficulty in rising as far as the opening. In a variant, the opening can be located at the bottom of the housing and the stack of applicators can descend by gravity as the applicators are removed. Such a system requires the use of applicators with hollow handles that can only be used as a grasping element. The applicators can also include the product to be applied which is either directly impregnated into the applicator portion, or covers the applicator portion so that the product is not protected inside the dispenser. The quantity of product is also limited by the size of the applicator portion.

U.S. Pat. Nos. 4,053,242 and 4,101,053 also describe a T-shaped single-use applicator dispenser including a cylindrical housing having a lateral opening provided to allow the removal of applicators in proximity to the bottom of the housing. The applicators are stacked flat in the housing, i.e. the applicator portion is folded in two so as to be located in the same plane as the handle thereby limiting the dimensions of the stack of applicators. This additionally serves to protect the application surface which is folded back on itself. Here again, the applicator portion can be impregnated with the product to be applied or can be covered by a layer of product. A spring is provided in the upper part of the housing to push the stack of applicators towards the bottom of the housing so that an applicator is always against the lateral opening. A pushbutton is additionally provided at the bottom of the housing, opposite the opening, to push the applicator located at the bottom of the housing through the opening so that the applicator handle can be grasped by the user. Such a dispenser has a relatively complicated structure. Moreover, the pressure exerted by the spring on the applicators is liable to damage the applicator portion as well as the handle. In addition, as the applicator portion remains folded in two inside the dispenser, it can deteriorate in this position and may have difficulty unfolding completely when the applicator is removed from the dispenser.

SUMMARY OF THE INVENTION

One of the objects of the invention is therefore to provide an applicator dispenser which avoids or reduces some or all of the drawbacks of the prior art.

Another object of the invention is to provide a dispenser which protects the application surface of the applicator and the product from the external environment.

A further object of the invention is to provide a dispenser which enables several applicators to be readily dispensed.

Another object of the invention is to provide such a dispenser which includes a small number of component parts.

Another object of the invention is to provide a dispenser which does not damage the applicator.

According to the invention, some or all of these objects can be achieved by providing a dispenser for at least one applicator which includes at least one receptacle configured to accommodate at least one applicator, with the receptacle having at least one opening through which the applicator can be withdrawn. At least one applicator is housed in the receptacle, and includes an applicator portion, and a grasping element enabling the applicator to be held, with the grasping element delineating a reservoir containing a product to be applied. The applicator is configured so that it must be at least partially deformed in order to pass through the opening in the receptacle.

An applicator dispenser is thus obtained which serves to protect the applicator portion from the external environment.

The applicator portion can be capable of deforming in order to pass through the opening.

By way of example, the applicator portion can include an application surface and, opposite this application surface, a rear face from which is formed or coupled the grasping element, with a portion of the rear face being situated against the wall of the receptacle delineating the opening of the applicator dispenser so as to prevent the applicator from passing through the opening without an external action being exerted on the applicator. The applicator is thus held inside the receptacle simply by virtue of the shape of the applicator and the opening in the receptacle.

Also by way of example, at least part of the grasping element can extend outwardly from the receptacle through the opening. Grasping of the applicator is thus further assisted in order to facilitate dispensing.

The grasping element can form a non-zero angle with the applicator portion, in particular a substantially right angle for example.

Before the first use, the applicator portion can be isolated from the product. To this end, the grasping element can include a membrane isolating the applicator portion from the inside of the reservoir. The membrane can be capable of opening under the pressure of the product so as to allow the product to pass towards the applicator portion. Alternatively, the grasping element can include two walls fixed between themselves on an attachment zone, such as by a weld or an adhesive zone, isolating the applicator portion from the inside of the reservoir, and the attachment zone can be capable of detaching under the pressure of the product so as to allow the product to pass towards the applicator portion.

The grasping element can be in the form of a sachet, a tube or any other container.

The opening can be a slot. Alternatively, the opening can have any other shape chosen in particular in relation to the shape of the grasping element.

The receptacle can include, for example, a side wall and a bottom.

According to a first embodiment, the receptacle can have an elongated shape and can include an opening formed in the bottom of the receptacle, with the applicators being superimposed inside the receptacle.

According to a second embodiment, the receptacle can include several openings disposed in an angular arrangement on the side wall of the receptacle.

According to a third embodiment, the receptacle can be in the form of a case and can additionally include a transverse wall, at a distance from the bottom, which incorporates several openings. In this embodiment, the applicator portion of the applicators rests on the bottom.

The applicator portion of the applicator can be made of a resiliently deformable material. By way of example, the applicator portion can be made of a porous or fibrous material, in particular a thermoplastic foam material, sponge, felt or natural fibres, in particular cotton.

The applicator portion can also include, for example, an application surface covered with flock material, non-woven or woven material.

With respect to a cross-section through the thickness, the applicator portion can have a convex shape, at least on that side of the face serving to apply the product. Alternatively, the applicator portion can have a flat shape in cross-section through the thickness.

When viewed frontally, the applicator portion can have a circular shape, or alternatively a non-circular shape, for example a generally triangular, square, oval, drop or almond shape.

The product can be in liquid, semi-liquid, paste or powder form.

The product can be a cosmetic or dermatological product. By way of example, the device of the invention can be particularly advantageous for products such as an anti-bacterial product, a sun screen, a moisturizing product, an anti-wrinkle product, a nail varnish, a foundation, a blusher, an eyeshadow, a lip colour, a make-up remover, a hair care product, a hair colouring product, a deodorant or an anti-perspirant, or a perfume.

As should be apparent, the invention can provide a number of advantageous features and benefits. It is to be understood that, in practicing the invention, an embodiment can be constructed to include one or more features or benefits (or objects) of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

Apart from the arrangements described above, the invention comprises a certain number of other features which will be explained below, in relation to the non-limiting embodiments, described with reference to the attached figures wherein:

FIG. 1 illustrates a perspective view of an applicator intended to be dispensed by a dispenser according to the invention;

FIG. 2 is a cross-sectional view of the applicator in FIG. 1;

FIGS. 3 and 4 illustrate an alternative embodiment of the applicator;

FIGS. 5A to 5E illustrate alternative embodiments of the applicator;

FIG. 9 illustrates a second embodiment of a dispenser according to the invention;

FIG. 10 illustrates a third embodiment of a dispenser according to the invention.

DETAILED DESCRIPTION OF THE PREFERRED EMBODIMENTS

Figure 6:
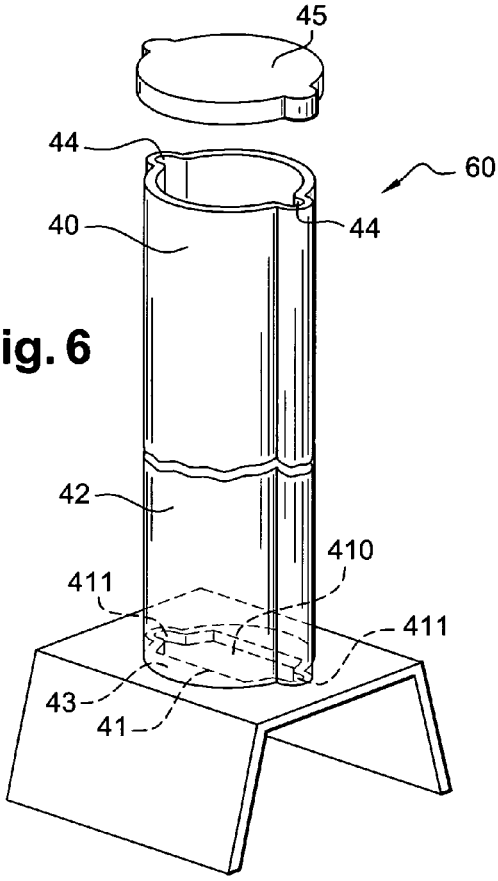
FIG. 6 illustrates a perspective view of a first embodiment of a dispenser for an applicator illustrated in FIG. 1 according to the invention.

FIGS. 1 to 4 depict T-shaped applicators suitable for the application of a product to the skin, mucous membranes or other external parts of the body, and intended to be dispensed from a dispenser according to the invention, illustrated in particular in FIGS. 6 to 12. The product to be applied is fluid, and in particular can be in liquid, semi-liquid, paste or powder form.

The applicator 10 depicted in FIGS. 1 and 2 includes an applicator portion 20 and a grasping element 30 extending substantially perpendicular to the applicator portion in the preferred illustrated example.

The applicator portion 20 can include, for example, a layer of a porous or fibrous material, in particular a resiliently deformable material, such as an open cell foam, a felt or any other cellular structure, such as natural or synthetic sponge, or fibrous structures in such as cotton or textile materials, or a superimposed combination of these.

As a variant, by way of example, an applicator portion that includes or is composed of a film can be utilized, and the film can have a relatively small thickness.

When viewed frontally, the applicator portion 20 can have a circular shape and a substantially constant thickness imparting a flattened shape thereto.

The applicator portion 20 defines on one side an application surface 21 intended to be applied on an area to be treated and, on the opposite side, a face 22 connecting to the grasping element 30.

The grasping element takes the form of a relatively flat sachet 30 composed of two sheets 31 and 32 coupled, e.g., welded, together along their periphery so as to delineate a space forming a reservoir for the product. Each of the sheets is formed from an alumino-plastic composite, for example a composite of aluminium, polyethylene and polyethylene terephthalate. The sachet 30 has, for example, a capacity of approximately 1 ml.

The sachet illustrated is generally rectangular in shape, however other shapes can be used in accordance with the invention.

The part 35 of the peripheral weld located in proximity to the applicator portion 20 is sufficiently solid to hold the two sheets welded together so as to perfectly isolate the applicator portion from the product contained in the sachet. The part 35 of the weld or coupling must however be sufficiently weak to be able to detach or break under the pressure of the product, in response to an overpressure created inside the sachet when the user presses the two sheets together.

To attach the sachet to the applicator portion, the two sheets 31 and 32 each extend on either side of the weld 35 by two portions 33 and 34 coupled, e.g., welded, to the rear face 22 of the applicator portion. In the example illustrated, the portions 33 and 34 of the sheets cover the whole of the rear face 22 of the applicator portion. It can of course be arranged for the portions 33 and 34 of the sheets to only partially cover the rear face 22 of the applicator portion. Instead of being welded to the rear face 22, the two sheet portions 33 and 34 can be glued, for example.

As a variant, an intermediate part made of flexible plastic can be provided between the sachet and the applicator portion. The rear face of the applicator portion can then be glued or welded to this component and to the sachet.

Preferably, the width of the sachet measured in the plane of the sachet is greater than the diameter of the applicator portion such that at least one side of the sachet projects laterally beyond the applicator so that, as will be seen in detail in the remainder of the description, the dispensing thereof is facilitated.

The applicator 110 illustrated in FIGS. 3 and 4 differs from that just described, in particular in that the applicator portion 120 has a domed application surface 121, for example outwardly convex, with the applicator portion being additionally oval in transverse cross-section. In addition, the application surface 121 includes a flock covering 123.

The sachet 30 is also replaced by a tube 130 which includes flexible walls 131 and a head 132 that is closed off, before first use, by a membrane 133. The membrane 133 is impervious to the product so as to isolate the applicator portion from the product contained in the reservoir. The membrane 133 can be made for example of polyethylene, polypropylene, PVC, polyamide, thermoplastic elastomers (SEBS), polycarbonates or polyurethane. The membrane 133 is capable of tearing when overpressure is created inside the tube in response to pressure exerted on the walls of the tube, thereby placing the applicator portion 120 in communication with the inside of the reservoir.

To secure the tube 130 to the applicator portion 120, the head of the tube 132 is for example force-fitted into a recess 124 emerging on the rear face 122 of the applicator portion 120.

To fix the applicator portion to the tube, an intermediate part made of flexible plastic can alternatively be provided between the tube and the applicator portion. The intermediate part can then be glued or welded to the rear face of the applicator portion and snapped or screwed onto the head of the tube.

In the two examples just described, the applicator portion 20 or 120 can also be pre-impregnated with a second product, also in liquid, semi-liquid or paste form, or in powder form. This would make it possible in particular to apply two mutually incompatible preparations or preparations that are unstable over time, by means of extemporaneous mixing at the time of application.

The applicator portion 10 or 110 can of course have a shape other than those just described, adapted in particular to the area of the body or face on which it is to be applied.

When viewed frontally, the applicator portion 10 or 110 can have a shape other than circular, for example to enable a product to be applied more easily or more precisely to a given part of the face, for example the eyelids or the lips.

FIGS. 5A to 5E depict frontal views of various examples of possible shapes, among others. When viewed frontally, the applicator portion 10 or 110 can be substantially square (FIG. 5A), oval (FIG. 5B), triangular (FIG. 5C), almond shaped (FIG. 5D) or drop shaped (FIG. 5E).

Figure 7:
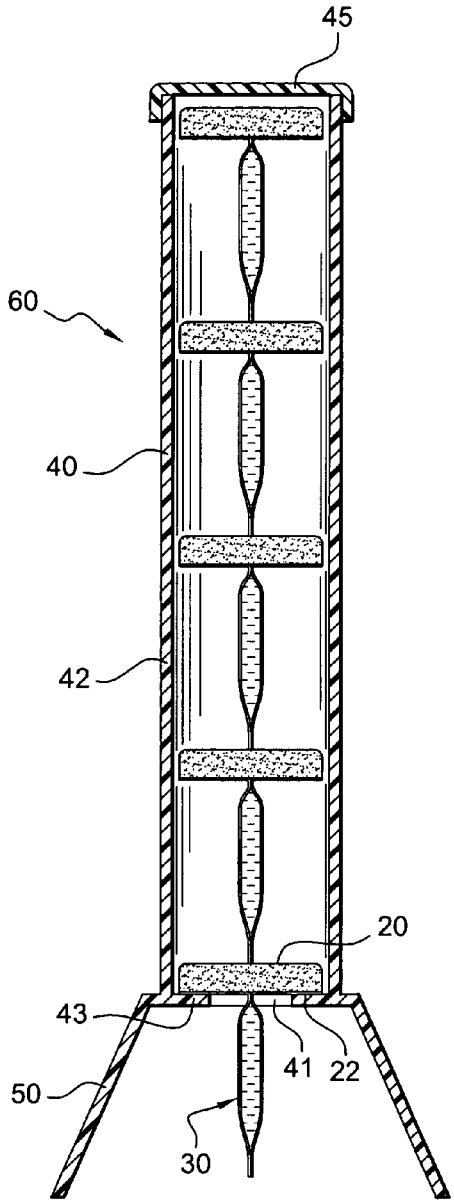
FIG. 7 is a cross-sectional view of the dispenser illustrated in FIG. 6, filled with applicators.
Figure 8:
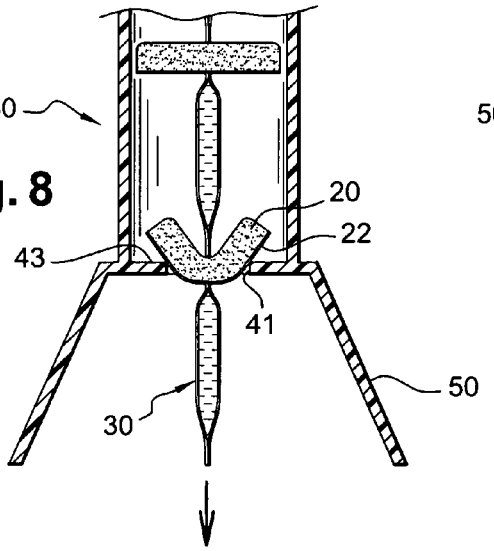
FIG. 8 partially illustrates the device in FIG. 7 in the process of being used.

FIGS. 6 to 8 illustrate a first embodiment of a dispenser 60 configured to dispense the applicators 10 such as described in FIGS. 1 and 2.

The dispenser 60 includes a receptacle 40 for the applicators 10 which is supported on a base 50.

The receptacle 40 takes the form of a cylinder of generally circular transverse cross-section in the illustrated example. It is evident that the transverse cross-section of the receptacle can have any other shape. It will preferably be chosen in relation to the shape of the applicator portion.

The receptacle 40 has an elongated shape and includes a sidewall 42 and a bottom 43. The top of the cylinder can be closed by a cover 45. The sidewall 42 incorporates two diametrically opposite guide slots 44, which extend to the full height of the sidewall 42.

An opening 41 is formed in the bottom 43 of the receptacle to facilitate withdrawal of the applicators. By way of example, in the illustrated arrangement, the opening 41 includes a rectangular portion 410 and is extended, on each of its smaller sides, by two notches 411 located in alignment with the guide slots 44.

As depicted in FIG. 7, the applicators 10 are superimposed inside the receptacle 40 with their sachet 30 oriented towards the opening 41. In addition, the sachet 30 of the applicator located closest to the opening 41 emerges from the receptacle through the opening 41. To prevent this applicator from simply dropping out of the receptacle by gravity, the rear face 22 of the applicator portion is abutted against part of the bottom 43 of the receptacle delineating the opening.

The size of the opening is chosen in relation to the size of the applicator and its capacity to deform in order to pass through the opening. The rectangular portion 410 should be sufficiently large so that the applicator portion 20 can easily pass through it without undue deformation. It must however be smaller than the surface of the applicator portion so that the rear face 22 rests on the bottom 43.

The base 50 serves to hold the dispenser on the surface on which it is intended to be placed. It also serves to maintain the opening 41 at a distance from this surface such that the sachet 30 can leave the receptacle without touching this surface.

To remove an applicator, all that is required is to grasp and pull on the sachet 30 emerging from the receptacle, thereby withdrawing the entire applicator. The applicator portion 20 folds or deflects back slightly on itself, as can be seen in FIG. 8, in order to pass through the opening 41. During this movement, the stack of applicators in the receptacle descends by gravity by a height corresponding to the height of one applicator. By virtue of the presence of the guide slots which guide the sachets, the stack of applicators is not liable to rotate inside the receptacle, so that the sachet of the applicator immediately following the one withdrawn passes through the opening and assumes the same position as the one just withdrawn.

To facilitate guidance of the applicators in the receptacle, provision can also be made to use applicators that incorporate an applicator portion having a shape other than circular and to use a receptacle having a transverse cross-section of the same shape. This dispenses with the need for the two guide slots. In such a case, it is not necessary for the width of the sachet measured in the plane of the sachet to be greater than the diameter of the applicator portion, as the applicators are then guided by the shape of the applicator portion and not by the sachet.

To use the applicator, it is simply necessary to press the two sheets of the sachet to create overpressure inside the latter which detaches the weld 35. The product can then flow towards the applicator portion which can be applied to the area of the body to be treated.

According to another embodiment illustrated in FIG. 9, the dispenser 160 includes a cylindrical receptacle 140 of relatively flattened shape. It includes a sidewall 142 and a bottom 143. A cover 145 can close the top of the receptacle.

According to this embodiment, the receptacle includes several openings 141 formed in this instance in the sidewall 142. The openings 141 are spaced in angular fashion around the entire circumference of the sidewall 142.

As can be seen in FIG. 9, the receptacle 140 has a circular cross-section, but the receptacle can have a cross-section other than circular in accordance with the invention, for example, oval or polygonal, rectangular, triangular, etc. The openings in this instance are also preferably spaced around the entire circumference of the sidewall of the receptacle.

An applicator 10 can be disposed in each opening 141. As in the embodiment described above, the applicator 10 is disposed inside the receptacle with its sachet extending beyond the sidewall 142 through the opening 141.

The dispenser can also include several receptacles 140 such as that just described, the different receptacles being superimposed as illustrated in FIG. 10.

Figure 11:
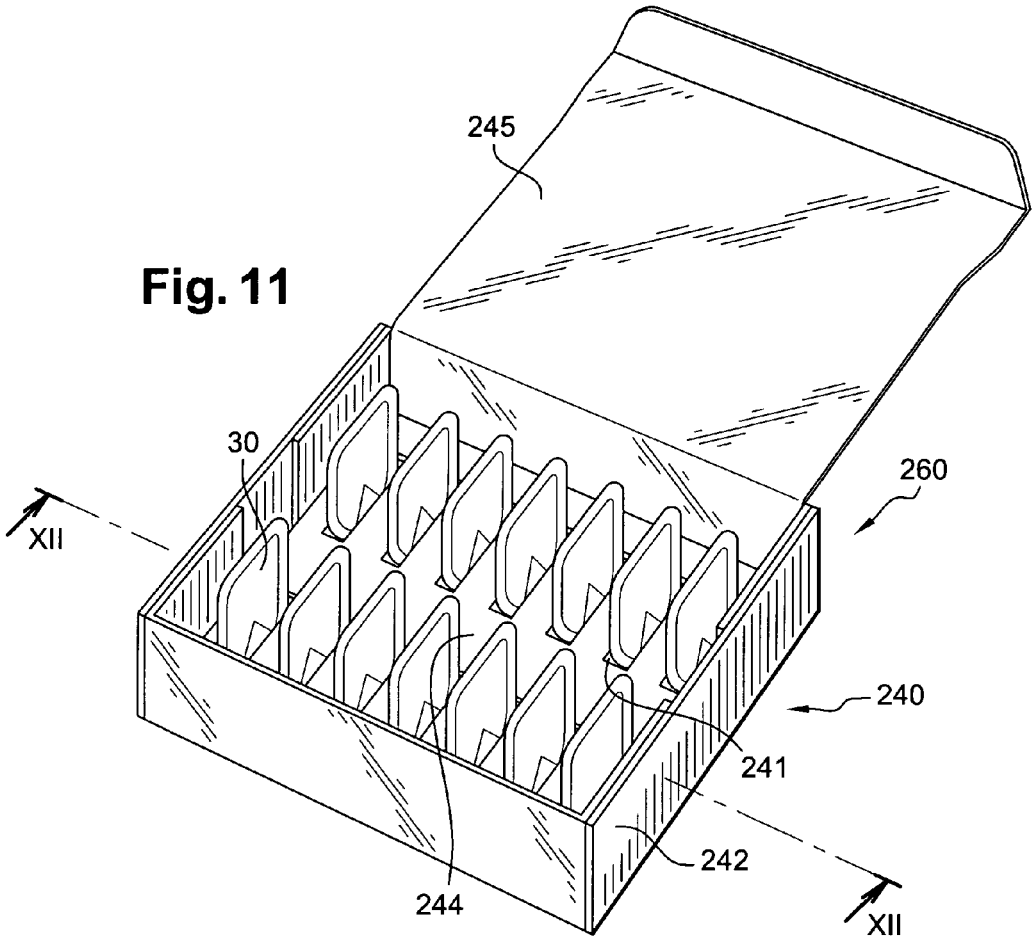
FIGS. 11 and 12 illustrate a fourth embodiment of a dispenser according to the invention.
Figure 12:
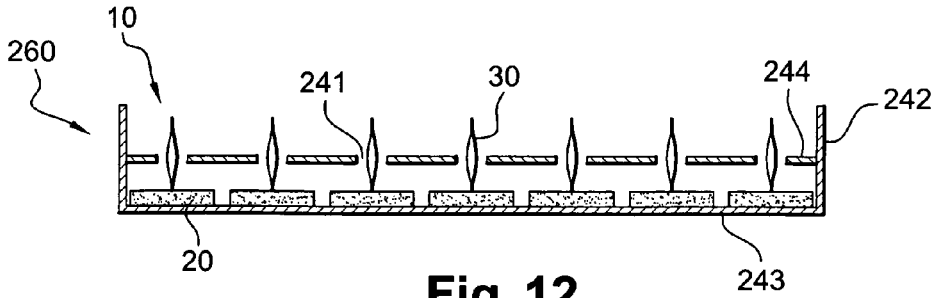

According to another embodiment illustrated in FIGS. 11 and 12, the dispenser 260 includes a receptacle 240 in the form of a case. It includes a sidewall 242 and a bottom 243.

According to this embodiment, the receptacle includes several openings 241 formed in this instance in a transverse wall 244, substantially parallel to the bottom 243 and located a short distance from the bottom, in particular at a distance just sufficient to form a compartment to receive the applicator portions 20 of the applicators. The sidewall 242 extends above the transverse wall to a height enabling the applicators to be accommodated. A cover 245 is additionally provided on one side of the sidewall to close the top of the case.

An applicator 10 can be disposed in each opening 241. The applicator 10 is arranged inside the receptacle with its applicator portion 20 resting on the bottom 243 of the receptacle and its sachet projecting beyond the transverse wall 244 through the opening 241, the sachet extending substantially perpendicular to the bottom 243 and to the transverse wall 244. The applicator portion 20 is then perfectly protected in the compartment formed between the bottom 243 and the transverse wall 244. In addition, when the cover 245 is closed, it protects the array of applicators.

The receptacle 240 illustrated has a square cross-section, but the receptacle can have a cross-section other than square in accordance with the invention, for example, circular, oval, rectangular, triangular, etc.

The dispensers just described can be located at points of sale, for example, by being placed on a display stand. Alternatively, provision can be made for the dispenser to be directly integrated into an existing display stand at the point of sale and for the opening(s) to be formed in such a stand.

The dispensers described above can serve in particular to dispense several samples of different products with no risk of the different samples being confused by the user. In effect, given that the sample product reservoirs are located outside the dispenser, all that is required is to change the visual appearance of the reservoir, for example using different colors depending on the product held in the reservoir. It is possible for example to use a blue-colored reservoir for a cream for dry skin, green for a cream for oily skin, or pink for a cream for combination skin. The user can then select from the same dispenser the sample that he/she wishes to try.

In the foregoing detailed description reference is made to preferred embodiments of the invention. It is evident that variants thereto can be proposed without departing from the invention as claimed here below. Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A dispenser for at least one applicator including:

at least one receptacle configured to accommodate at least one applicator, wherein the receptacle includes at least one opening through which the applicator is configured to be withdrawn and wherein a periphery of the at least one opening defines a non-resilient ledge;

at least one applicator, housed in the receptacle, the applicator including:

an applicator portion;

a grasping element enabling the applicator to be held, wherein the grasping element delineates a reservoir containing a product to be applied; and wherein the applicator is configured so that it must be at least partially deformed in order to pass through the opening in the receptacle, wherein the applicator portion includes an application surface and, opposite the application surface, a rear face which is coupled to the grasping element, and wherein prior to removal of the applicator from the receptacle, a portion of the rear face is configured to contact a surface of the ledge of the receptacle so as to prevent the applicator from passing through the opening without an external force being exerted on the applicator.

2. A dispenser according to claim 1, wherein the applicator portion is capable of deforming in order to pass through the opening.

3. A dispenser according to claim 2, wherein the applicator portion includes an application surface and, opposite this application surface, a rear face to which is coupled the grasping element, wherein prior to removal of the applicator from the receptacle, a portion of the rear face is situated against a wall of the receptacle delineating the opening so as to prevent the applicator from passing through the opening without an external force being exerted on the applicator.

4. A dispenser according to claim 1, wherein at least a part of the grasping element emerges from the receptacle through the opening.

5. A dispenser according to claim 1, wherein the grasping element forms a non-zero angle with the applicator portion.

6. A dispenser according to claim 5, wherein the grasping element forms a substantially right angle with respect to the applicator portion.

7. A dispenser according to claim 1, wherein the applicator portion is, before first use, isolated from the product.

8. A dispenser according to claim 7, wherein the grasping element includes a membrane isolating the applicator portion from the inside of the reservoir, the membrane being capable of opening under the pressure of the product so as to allow the product to pass towards the applicator portion.

9. A dispenser according to claim 7, wherein the grasping element includes two walls coupled to each other in an attachment zone isolating the applicator portion from the inside of the reservoir, wherein the attachment zone is capable of at least partially detaching under a pressure of the product so as to allow the product to pass towards the applicator portion.

10. A dispenser according to claim 9, wherein the attachment zone includes at least one of a weld and an adhesive.

11. A dispenser according to claim 1, wherein the gasping element is in the form of a sachet.

12. A dispenser according to claim 1, wherein the gasping element is in the form of a tube.

13. A dispenser according to claim 1, wherein the receptacle includes a sidewall and a bottom.

14. A dispenser according to claim 13, wherein the receptacle has an elongated shape and includes the at least one opening formed in the bottom of the receptacle, and wherein a plurality of applicators are superimposed inside the receptacle.

15. A dispenser according to claim 13, wherein the receptacle includes a plurality of openings spaced along the side wall of the receptacle.

16. A dispenser according to claim 15, wherein the openings are angularly offset with respect to each other.

17. A dispenser according to claim 13, wherein the receptacle is in the form of a case and additionally includes a transverse wall, positioned at a distance from the bottom, and wherein the transverse wall includes a plurality of openings.

18. A dispenser according to claim 17, wherein the applicator portion of the applicators rests on the bottom.

19. A dispenser according to claim 1, wherein the applicator portion of the applicator is made of a resiliently deformable material.

20. A dispenser according to claim 1, wherein the applicator portion is made of a porous or fibrous material.

21. A dispenser according to claim 20, wherein the applicator includes a material selected from the group consisting of: a thermoplastic foam material, sponge, felt, and natural fibers.

22. A dispenser according to claim 1, wherein the applicator portion includes an application surface covered with a material selected from the group consisting of: a flock material, a non-woven material, and a woven material.

23. A dispenser according to claim 1, wherein the applicator portion has a convex shape in cross-section through its thickness, with the convex shape at least on a side serving to apply the product.

24. A dispenser according to claim 1, wherein the applicator portion has a flattened shape in cross-section through its thickness.

25. A dispenser according to claim 1, wherein when viewed frontally, the applicator portion has a circular shape.

26. A dispenser according to claim 1, wherein when viewed frontally, the applicator portion has a non-circular shape selected from the group consisting of triangular, square, oval, drop and almond shape.

27. A dispenser according to claim 1, wherein the product is one of a liquid, a semi-liquid, a paste and a powder.

28. A dispenser according to claim 1, wherein the product is a cosmetic or dermatological product.

29. A dispenser according to claim 1, wherein the product is one of an anti-bacterial product, a sun screen, a moisturizing product, an anti-wrinkle product, a nail varnish, a foundation, a blusher, an eyeshadow, a lip color, a make-up remover, a hair care product, a hair coloring product, a deodorant or an antiperspirant, or a perfume.

30. A dispenser according to claim 1, wherein the opening in the receptacle is non-circular.

31. A dispenser according to claim 30, wherein the grasping element extends through the opening to at least partially project out of the receptacle prior to removal of the at least one applicator from the receptacle.

32. A dispenser according to claim 31, wherein the opening includes at least one notch through which a portion of the grasping element extends prior to removal of the applicator from the receptacle.

33. A dispenser according to claim 32, wherein the grasping element has a width larger than a width of the applicator portion.

34. A dispenser according to claim 1, wherein the grasping element has a width larger than a width of the applicator portion.

35. A dispenser according to claim 1, wherein a plurality of said applicators are superposed in said receptacle, and wherein the grasping element of a lowermost one of said plurality extends through the opening to at least partially project out of the receptacle prior to removal of the lowermost applicator from the receptacle.

36. A dispenser according to claim 1, wherein a plurality of openings are associated with the at least one receptacle and wherein a plurality of applicators are provided such that at least one grasping element extends through each of said plurality of openings.

37. A dispenser according to claim 36, wherein the plurality of openings are positioned at substantially the same height.

38. A dispenser according to claim 36, wherein said plurality of openings are provided at different heights of the at least one receptacle.

39. A dispenser according to claim 36, wherein the plurality of openings are provided at locations spaced about a periphery of the at least one receptacle.

40. A dispenser according to claim 1, wherein the applicator has a T-shaped cross-section, and wherein at least part of the grasping element extends outside of the receptacle and at least part of the applicator portion is inside of the receptacle prior to removal of the applicator from the receptacle.

41. A dispenser according to claim 1, wherein the applicator portion includes a first face and a second face, wherein the first face is used for applying the product and the grasping element is coupled to the second face, and wherein prior to removal of the applicator from the receptacle the first face faces in a direction away from the opening of the receptacle and the second face faces in a direction toward the opening of the receptacle.

42. A dispenser according to claim 41, wherein prior to removal of the applicator from the receptacle the grasping element passes through said opening to at least partially extend outside of the receptacle.

43. A dispenser according to claim 42, wherein a grasping element of an applicator in the receptacle rests on the first face of an applicator located immediately below.

44. A dispenser according to claim 43, wherein a plurality of applicators located in the receptacle do not overlap with each other.

45. A dispenser according to claim 32, wherein the receptacle further includes at least one guide slot formed along a length of the receptacle that is substantially aligned with the at least one notch formed in the opening.

46. A dispenser according to claim 1, wherein a periphery of the at least one opening defines a ledge, and wherein the applicator portion includes an application surface and, opposite the application surface, a rear face which is coupled to the grasping element, and prior to removal of the applicator from the receptacle, a portion of the rear face is configured to contact the ledge of the receptacle so as to prevent the applicator from passing through the opening without an external force being exerted on the applicator.

47. A dispenser according to claim 1, wherein the ledge forms the entire periphery of the at least one opening.

* * * * *